United States Patent [19]

Munk et al.

[11] 4,369,716

[45] Jan. 25, 1983

[54] DISPLAY PALLET

[75] Inventors: Edmund Munk, Oberstenfeld; Helmuth Huber, Oberstenfeld-Gronau, both of Fed. Rep. of Germany

[73] Assignee: Furnier-U. Sperrholzwerk, J. F. Werz Jr. KG, Oberstenfeld, Fed. Rep. of Germany

[21] Appl. No.: 146,176

[22] Filed: May 2, 1980

[30] Foreign Application Priority Data

May 9, 1979 [DE] Fed. Rep. of Germany ..... 2918574

[51] Int. Cl.[3] ..... B65D 19/24

[52] U.S. Cl. ..... 108/51.1; 108/901

[58] Field of Search ..... 108/51.1, 51.3, 53.1, 108/53.3, 54.1-57.1; 206/386, 596, 598-600; 220/1.5

[56] References Cited

U.S. PATENT DOCUMENTS

| | | | |
|---|---|---|---|
| 2,121,269 | 6/1938 | Sisson | 108/51.1 X |
| 2,256,750 | 9/1941 | Riemenschneider | 108/51.1 |
| 2,536,587 | 1/1951 | Whalley | 108/57.1 |
| 2,936,986 | 5/1960 | Johnson | 108/51.1 |
| 3,093,216 | 6/1963 | Dunham | 108/51.1 X |
| 3,120,825 | 2/1964 | Johnson | 108/53.3 |
| 3,159,115 | 12/1964 | Nolan | 108/51.1 |

FOREIGN PATENT DOCUMENTS

| | | | |
|---|---|---|---|
| 2535907 | 2/1977 | Fed. Rep. of Germany | 108/53.3 |
| 1246854 | 9/1971 | United Kingdom | 220/1.5 |

*Primary Examiner*—William E. Lyddane

*Attorney, Agent, or Firm*—Michael J. Striker

[57] ABSTRACT

A display pallet has a rectangular load-bearing wall, two supporting walls extending along the longitudinal sides of the load-bearing wall, and a plurality of depressions provided in the walls and spaced from one another in the direction of elongation of the pallet. Each of the depressions has an extension formed at the lower end of each of the supporting walls and extending inwardly of the pallet.

11 Claims, 3 Drawing Figures

DISPLAY PALLET

BACKGROUND OF THE INVENTION

The present invention relates to a display pallet which together with an object can be put on a transport pallet and transported with the latter.

Display pallets of the above-mentioned general types are known in the art. A known display pallet is a stable supporting member adapted to be placed on a transport means. The display pallet is connected with an object after its manufacture, transported with the same, and serves as a stable support for the object. The object may be a machine or a device to be examined or sold. The object may also be composed of several boxes with foodstuffs, sweets or canned food which in condition of self-service must be located at a well visible place for exhibition purpose. The display pallets with the objects which are put and mounted thereon must be transported to their predetermined place in a simple manner. For this purpose, several display pallets with the objects are placed on transport pallets and transported. Both the transport pallets and the display pallets must be held and transported by the same transporting means. This, however, encounters some difficulties inasmuch as the transport pallets have, as a rule, widths of 600 mm., and a maximum distance of the holding device of the transporting means amounts to 550 mm. Thereby, the maximum thickness of both side walls of the display pallet must not exceed 25 mm.

SUMMARY OF THE INVENTION

Accordingly, it is an object of the present invention to provide a display pallet which avoids the disadvantages of the prior art.

More particularly, it is an object of the present invention to provide a display pallet which can be placed stably together with the object onto a transport pallet and transported, and which at the same time can be placed onto conventional transporting means.

In keeping with these objects and with others which will become apparent hereinafter, one feature of the present invention resides, briefly stated, in a display pallet which has a rectangular load-bearing wall and two supporting walls extending along the longitudinal sides of the load-bearing wall wherein a plurality of the depressions are formed in the walls, the depressions being provided with extensions which are formed at the lower ends of the supporting walls and extend inwardly of the pallet.

When the display pallet is constructed in accordance with the present dimensions, it may be placed together with the object onto a transport pallet to be transported with the latter, and at the same time it may be placed onto a transporting means.

The depressions may be groove-like and have a trapezoidal cross-section. They may be distributed over the entire load-bearing wall and spaced from one another by equal distances. The depressions form a plurality of ribs on the inner surfaces of the load-bearing wall and the supporting walls. The number of depressions is preferably four or a multiple of four.

In accordance with the further advantageous feature of the present invention, the pallet is formed as a one-piece molded member consisting of a mixture of fibers with a binding material.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENT

A display pallet according to the present invention has a box-like shape. The display pallet has a load-bearing wall 1 and two supporting walls 2. The supporting walls 2 extend along the longitudinal edges of the load-bearing wall 1.

A plurality of depressions 3 are provided in the load-bearing wall 1 and the supporting walls 2. The depressions 3 are groove-like and uniformly distributed over the walls of the display pallet, so as to be spaced by equal distances from one another. In the illustrated example, the depressions have a trapezoidal cross section. The display pallet is formed as a one-piece member. The number of the depressions 3 may be equal to four or to a multiple of four.

Figure 2:
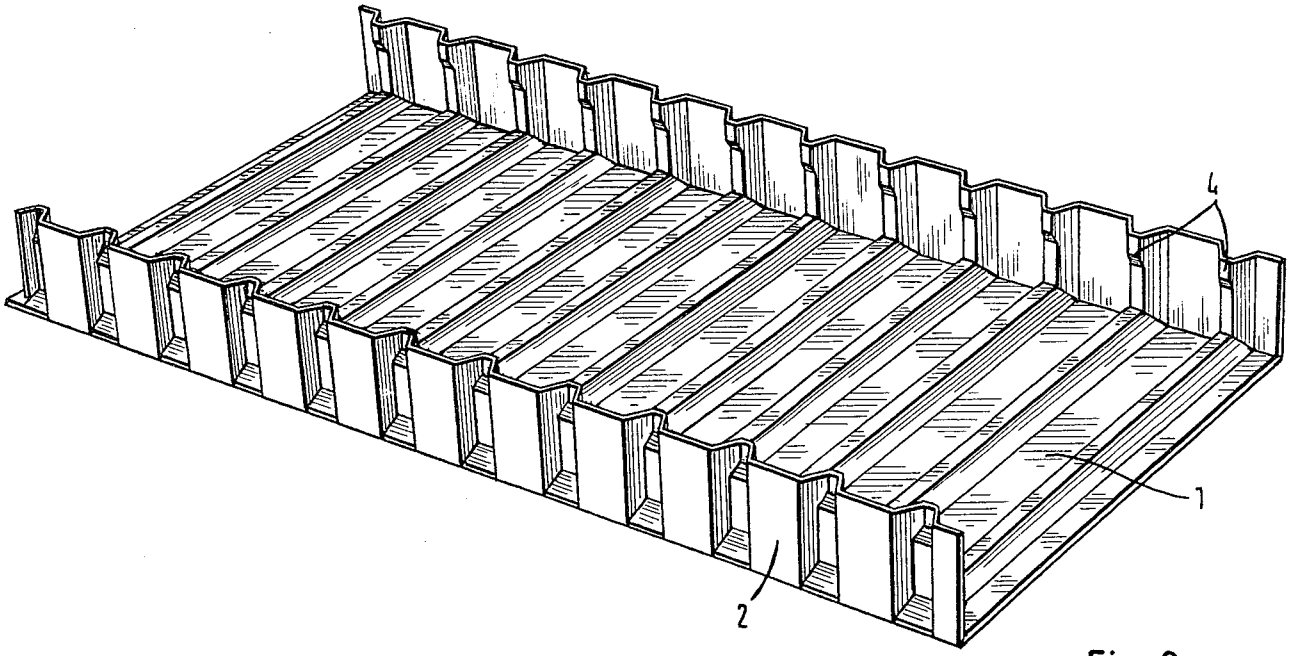
FIG. 2 is a perspective view showing a lower surface of the display pallet of FIG. 1.

As can be seen from FIG. 2 a plurality of ribs are formed on the inner surface of the load-bearing wall 1 and the supporting walls 2. The ribs are formed between the respective depressions 3. Each of the ribs is formed as an uninterrupted rib which extends from the lower end of one supporting wall upwardly and over this one supporting wall, then over the load-bearing wall 1, and then over the other supporting wall 2 downwardly to the lower end of the latter.

Each of the groove-like depressions 3 has an extension 4 formed at the lower end of each of the supporting walls 2. The extension 4 extends inwardly of the pallet. More particularly, the two extensions 4 of the same depression 3 extend toward one another in the direction which is transverse to the direction of the elongation of the pallet. The same is true with respect to the ribs formed between the depressions 3. Each rib has two extensions formed at the lower ends of the supporting walls 2 and extending towards one another.

Figure 1:
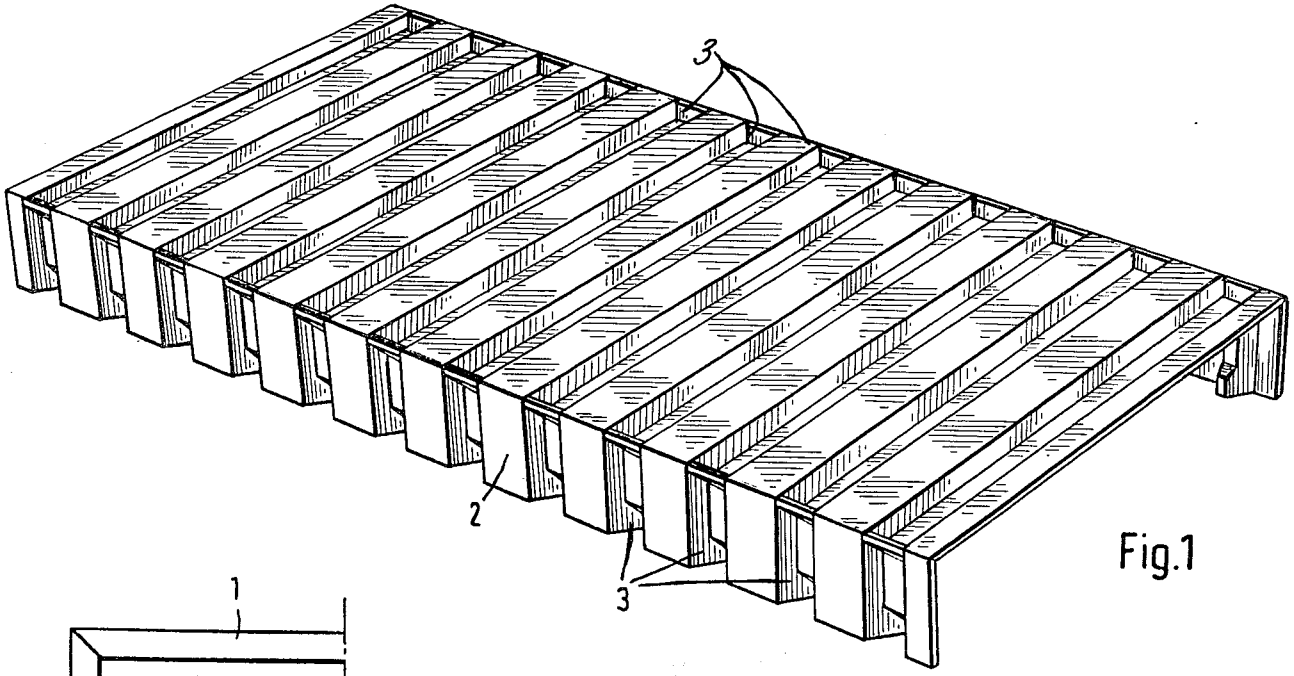
FIG. 1 is a perspective view showing an upper surface of a display pallet in accordance with the present invention.
Figure 3:
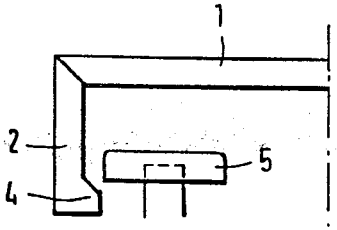
FIG. 3 is a view showing a section of the display pallet of FIG. 1.

The thus-constructed display pallet guarantees a stable position and has a sufficiently wide inner opening for the holding arrangement of the transporting means, despite a very small load-bearing face of the display pallet. This can be confirmed by the examination of FIG. 3. It can be seen from this figure that because of the respective shape of the supporting walls 2 and the extensions 4, a very high stability of the display pallet is attained. Despite this, a transporting means, such as for example rollers 5, can be received in a receiving opening of the display pallet.

It is especially advantageous when the inventive display pallet is manufactured in standard lengths as a molded member. Such a molded member may consist of a mixture of fibers, for example, ligno-cellulose fibers, such as comminuted and dried wood chips, begasse fibers and so on, with a heat-hardening synthetic resin, such as melamine urea formaldehyde resin or phenol formaldehyde resin. On the other hand, the above-mentioned fibers may consist of other materials such as glass fibers, rock wool or asbestos fibers, taken separately or mixed with one another. A binding material for example, an organic binding material, is added to these fibers.

It will be understood that each of the elements described above, or two or more together, may also find a useful application in other types of constructions differing from the types described above.

While the invention has been illustrated and described as embodied in a display pallets which are adapted to be placed on a transport pallet and transported with the latter, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A display pallet which is adapted to be placed on a transport pallet and transported with the latter, comprising a substantially rectangular body having a rectangular load-bearing wall with two longitudinal and two transverse sides; two lateral supporting walls each extending along a respective one of said longitudinal sides of said load-bearing wall and having a lower edge forming a supporting face, and a plurality of depressions forming a plurality of ribs spaced from each other in direction of elongation of said body and separate from one another over their entire length, each of said ribs extending over said load-bearing wall, both said supporting walls to the lower ends of the latter, and forming at said lower ends inwardly directed extensions.

2. A display pallet as defined in claim 1, wherein each of said depressions is groove-like.

3. A display pallet as defined in claim 1, wherein each of said depressions has a trapezoidal cross section.

4. A display pallet as defined in claim 1, wherein each of said walls has an outer surface and an inner surface, said depressions being provided in the outer surfaces of said walls so as to form a plurality of ribs on the inner surfaces of said walls.

5. A display pallet as defined in claim 1, wherein each of said ribs is an uninterrupted rib.

6. A display pallet as defined in claim 1, wherein two extensions of each of said ribs extend toward one another in the direction which is transverse to the direction of elongation of said pallet body.

7. A display pallet as defined in claim 1, wherein each of said ribs has a first portion formed in said load-bearing wall and two second portions each formed in a respective one of said supporting walls, the first portion and the two second portions of each of said ribs being formed at a common location as considered in the direction of elongation of said pallet body.

8. A display pallet as defined in claim 1, wherein said pallet body is a one-piece molded member constituted of a mixture of fibers with a binding material.

9. A display pallet as defined in claim 1, wherein said plurality of ribs includes four such ribs.

10. A display pallet as defined in claim 1, wherein said plurality of ribs includes a number of such ribs which is a multiple of four.

11. A display pallet as defined in claim 1, wherein said ribs are uniformly distributed over said load-bearing wall and spaced from one another by equal distances.

* * * * *